United States Patent [19]

Magnoni et al.

[11] Patent Number: 4,619,006

[45] Date of Patent: Oct. 28, 1986

[54] BED FOR PASSIVE, AUTOPASSIVE OR AGAINST PATIENT RESISTANCE MOTOR RE-EDUCATION, SUPPLIED WITH MECHANICALLY CONTROLLED AND BY ELECTRONIC OPERATED, PROGRAMMABLE AND CONTROLLABLE COMPONENTS

[75] Inventors: Pierangelo Magnoni; Pier E. Strada, both of Milan; Walter Cavagnis, Merate; Angelo Sanvito, Milan, all of Italy

[73] Assignee: O.F.M.E.C. Officine Meccaniche Mantovane S.p.A., Mantova, Italy

[21] Appl. No.: 706,325

[22] Filed: Feb. 27, 1985

[30] Foreign Application Priority Data

Feb. 28, 1984 [IT] Italy ..... 19825 A/84

[51] Int. Cl.[4] ..... A61G 7/06

[52] U.S. Cl. ..... 5/68; 5/60; 5/66; 269/325

[58] Field of Search ..... 5/60–68, 5/81 R; 269/324, 325

[56] References Cited

U.S. PATENT DOCUMENTS 3,972,081 8/1976 Stern et al. ..... 5/60 X 4,435,862 3/1984 King et al. ..... 5/60 X

FOREIGN PATENT DOCUMENTS 196794 6/1965 Sweden ..... 5/60

*Primary Examiner*—William F. Pate, III

*Assistant Examiner*—Richard E. Chilcot, Jr.

*Attorney, Agent, or Firm*—Charles E. Brown; Charles A. Brown

[57] ABSTRACT

Bed for passive, autopassive or against patient resistance motor re-education, supplied with twenty-one D.C. low voltage (on account of security) electric motors suitable to control respectively eleven mechanical assemblies applied to the bed and suited to cause the different movements of the patient, two further auxiliary mechanical assemblies constrained to the former and at last eight further mechanical assemblies suited to cause the positionings and the adjustments of the bed and of the aforesaid assemblies. It results that the bed is adjustable as height and revolving around their transverse axis. The operation of the motors is servo controlled as speed by speedometer dynamos, as angle shot by angular position circumferentors, as torque by torque detectors, and operated by a microprocessor, so that graduated, soft, constant, stable and repeated movements can be actuated and controlled as type, number, sequence, intensity, amplitude, duration, execution speed, acceleration and stall torque value.

7 Claims, 16 Drawing Figures

BED FOR PASSIVE, AUTOPASSIVE OR AGAINST PATIENT RESISTANCE MOTOR RE-EDUCATION, SUPPLIED WITH MECHANICALLY CONTROLLED AND BY ELECTRONIC OPERATED, PROGRAMMABLE AND CONTROLLABLE COMPONENTS

The present patent application for industrial invention relates to a bed for the motor re-education of the patient. It means a real revolution in the medical-industrial field to which it is destined.

For the first time it allows therefore, though known, both the motor passive and autopassive re-education and also that carried out in spite of the suitably controlled patient resistence.

First of all the subject bed is original as it results adjustable both on height and rotatory around their transverse axis.

Secondly it is original as provided with twenty-one electric DC and low voltage, i.e. security motors, which allow to control, through suitable mechanical asemblies, the different possible patient movements, and even more the positionings and adjustments of the bed on which he is laid or prone.

Thirdly it is also original since provided particularly with some mechanical assemblies having composition itself original, i.e. those to move respectively the headrest and back area of the bed, and those to move the linkages for supporting the arms and the legs of the patient.

Fourthly the bed at issue is original in that the different mechanical assemblies with which it is provided allow to let the patient execute as a whole a very wide range, and perhaps for the first time complete, of single exercises, simultaneous or variously alternate, relating to (a) flexural-extension motions of the backbone
(b) before placing and abduction motions of the shoulders and flexural-extension motions of the elbows
(c) flexured-extesion and abduction motions of the hips and flexural-extension motions of the knees, and the last whether the patient is in a supine or a prone position on the bed.

Fifthly, the bed is especially original in that it foresees that the operation of the twenty-one motions with which it is provided is servo controlled as speed by speedometer dynamos, as angle shot by angular position circumferencers and programmably operated by a microprocessor so that graduated, soft, constant, stable and repeated movements can be actuated and controlled as type, number, sequence, intensity, amplitude, duration, execution speed, acceleration and stall torque value.

The bed according to the invention is original at last in that, by means of the microprocessor—since provided with alphanumeric keyboard—it allows the operator to give only the allowable movements and always by means of the microprocessor—since provided with monitor and printer—it allows the operator to visualize the defined data, to learn the continuous adjournment of the same, the motion cycles into execution, the diagnosis of possible anomalies, to print the programs for filing and to evaluate the therapeutical results.

It was said before that the bed according to the invention means a real revolution in the medical-industrial field to which it is destinated. This is already obvious from their original constructive features listed above, but it is perhaps better evident if attention is paid to all the beneficent effects it makes possible for the patient, and which can be so summarized:

to keep or restore a certain sensibility and consciousness with the external world;
to inhibit articular rigidity;
to enable a better circulation of the blood;
to prevent the arising of oedemas;
to keep a good osteoarticular trophism and the muscular elasticity, and at last
to promote the memory and the execution of the harmonic succession of the gestures.

The enclosed drawings show a preferred embodiment of the bed according to the invention, given as non limitative exemple only.

More precisely

Figure 1:
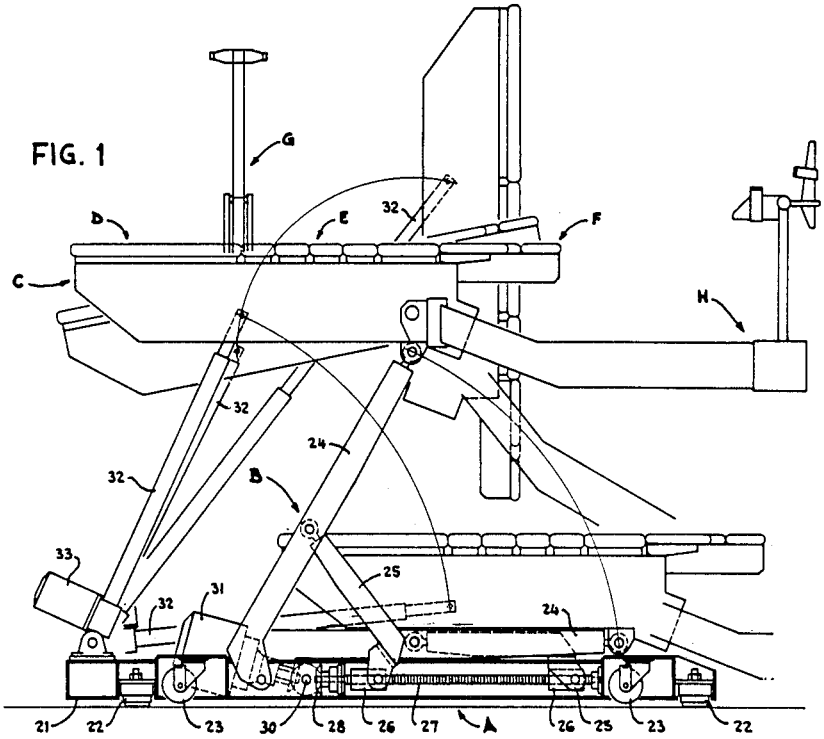
FIG. 1 is a lateral view of the bed in the phase of lifting with the respective motion devices.
Figure 2:
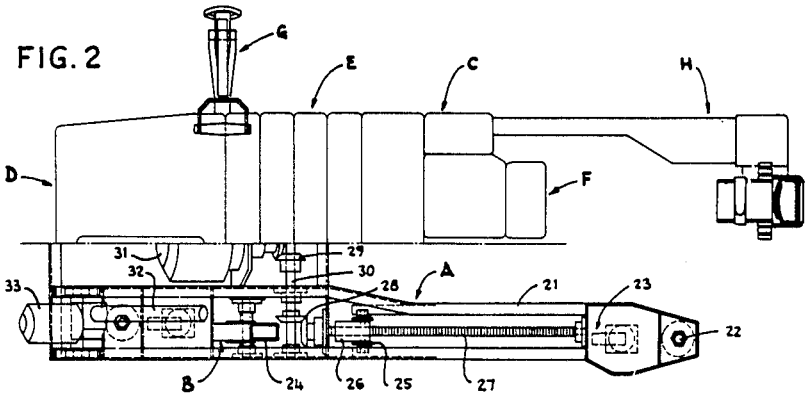
FIG. 2 is a plan view partly cutaway of the bed of FIG. 1.

As noticed by the drawings (FIGS. 1 and 2) the base of the bed is indicated by A, the lifting assembly of the bed is indicated by B, the decubitus plan is indicated by C. D (see FIGS. 3 to 6) shows a headrest, E the back area, F the thighrests, G the arm support leverages and at last H the legs support leverages.

The bed base A includes:

a frame 21 on which vibration-damping support blocks 22 are assembled, which, conveniently locked, ensure the bed stability during the movements drive. Pivoting wheels 23 allow, after the release of the support blocks 22, the bed shifting in an easy manner.

The bed lifting assembly B includes:

support levers 24 to which other thrust levers 25 are hinged, assembled on nutscrews 26 and screws 27, the rotation of which is transmitted, through gear pairs 28 and 29, keyed to the shaft 30, by the geared motor 31.

Said lifting assembly B allows the decubitus plane C to be positioned as needed and an easy transfer of the patient on the last from an illness bed or a roll light carriage. To this provide linear actuators 32 drived by motors 33, which allow the decubitus plane C to pass from the horizontal to the vertical position, permitting so their use as statics bed. On the other hand and limited to about 12°, the decubitus plane C can be inclined also in the negative (this position could find practical use in the case of temporary pressure drops of the patient during the re-education).

Figure 3:
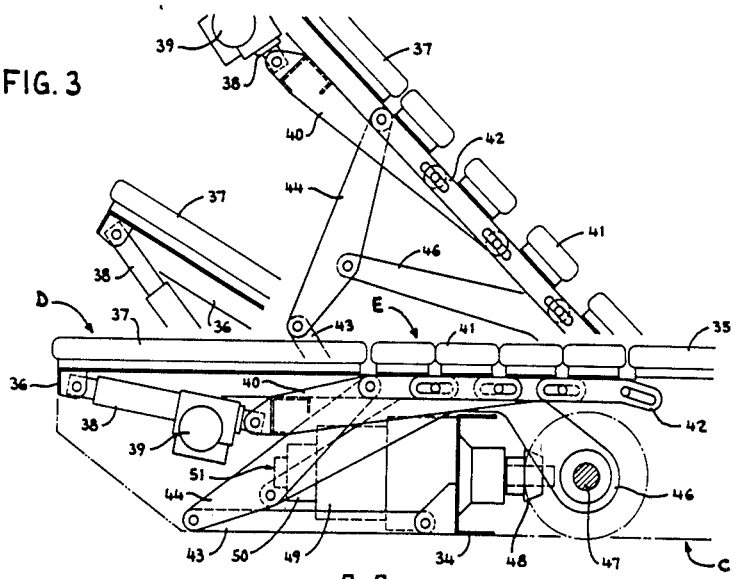
FIG. 3 is a partial lateral view of the bed or, more precisely of the headrest area and back of the same, viewed in the lifting phase with particular evidence for the respective original motion devices.
Figure 4:
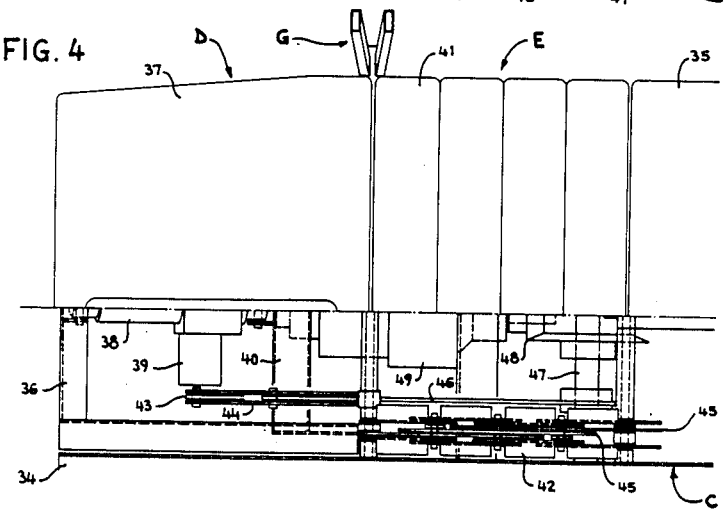
FIG. 4 is a plan view partly cutaway of the headrest and back area of the bed according FIG. 3.
Figure 5:
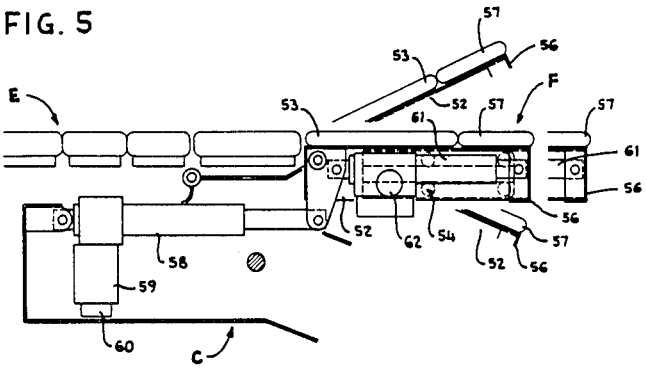
FIG. 5 is another partial lateral view of the bed and more precisely of the thighrest area, also in lifting phase being more evident the respective motion devices.
Figure 6:
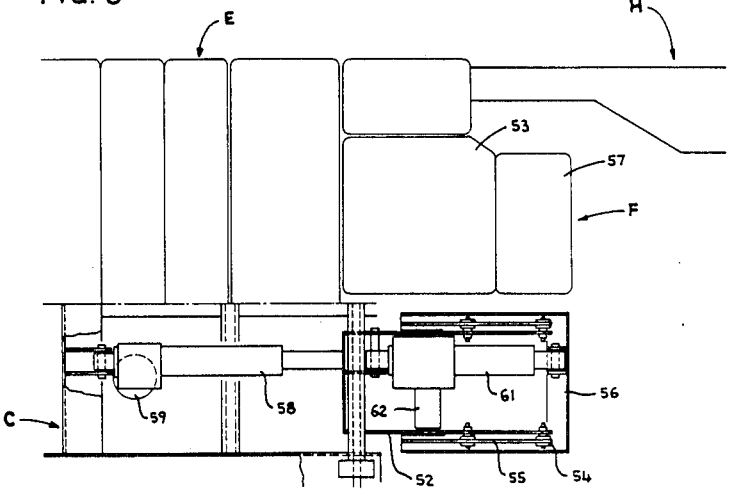
FIG. 6 is a plan view partly cutaway of the thighrest area of the bed of FIG. 5.
Figure 8:
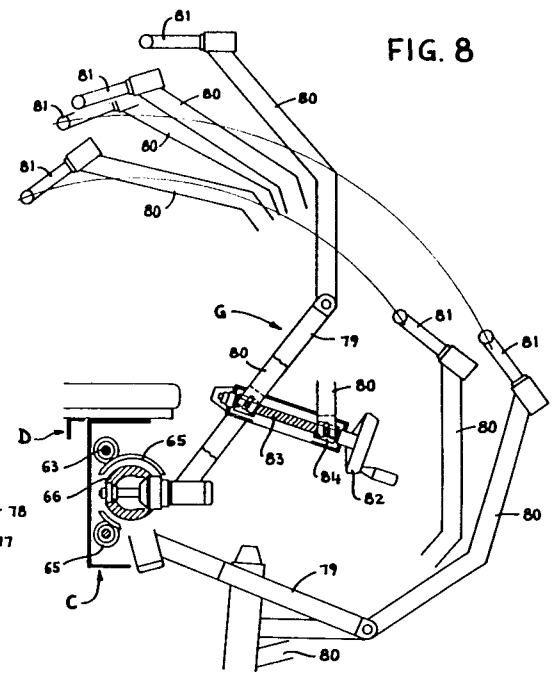
FIG. 8 is a front view of the same leverages shown in FIG. 7.
Figure 7:
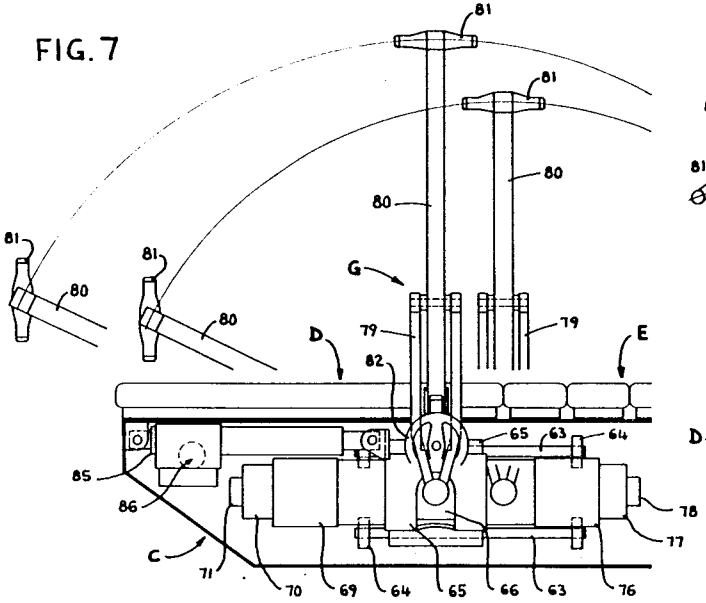
FIG. 7 is a lateral view of the support leverages of the arms shown in lifting phase.
Figure 9:
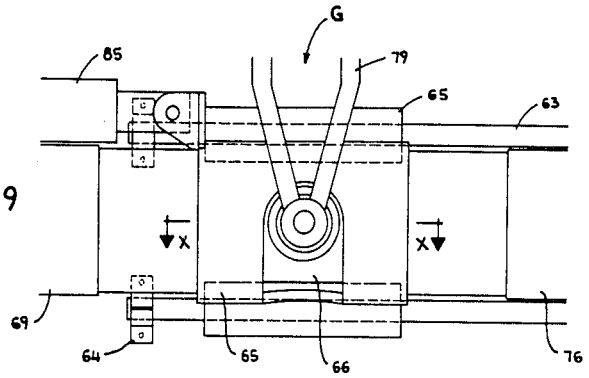
FIG. 9 is a lateral view of the original movement assembly of the support leverage of the arms.
Figure 10:
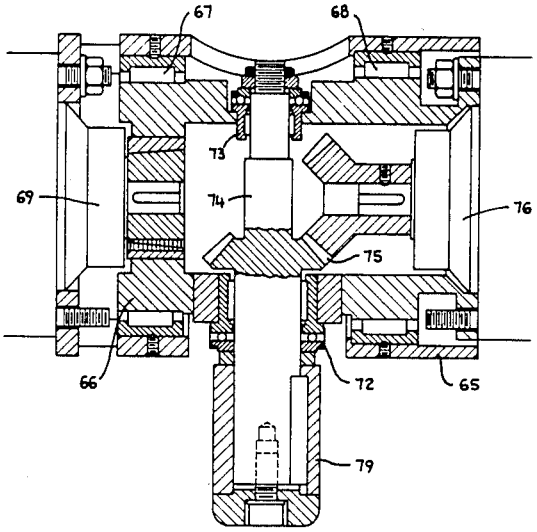
FIG. 10 is a longitudinal section according to the line X—X of FIG. 9.
Figure 13:
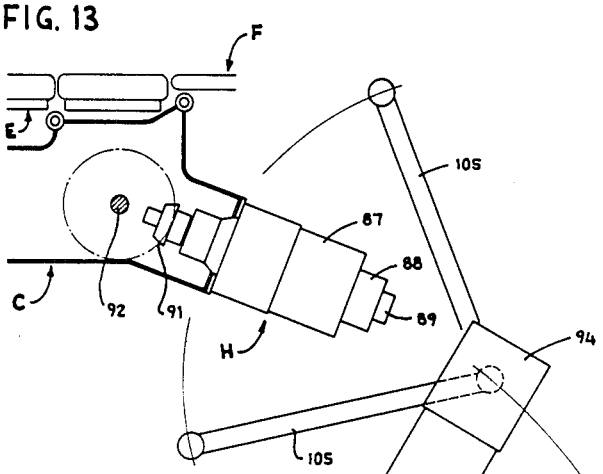
FIG. 13 is a cross section of the drive according to the line XIII—XIII of FIG. 12.
Figure 11:
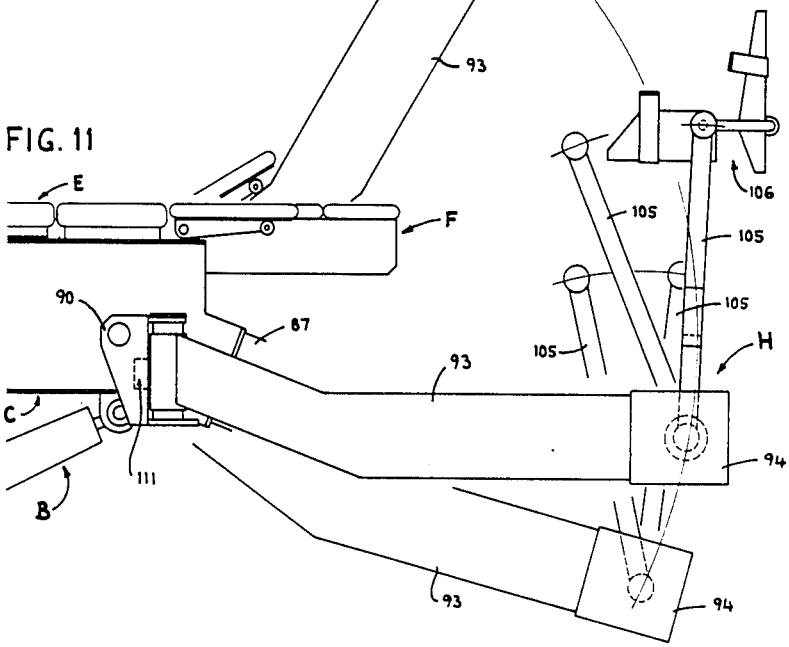
FIG. 11 is a lateral view of the support leverages of the legs shown in lifting phase.
Figure 12:
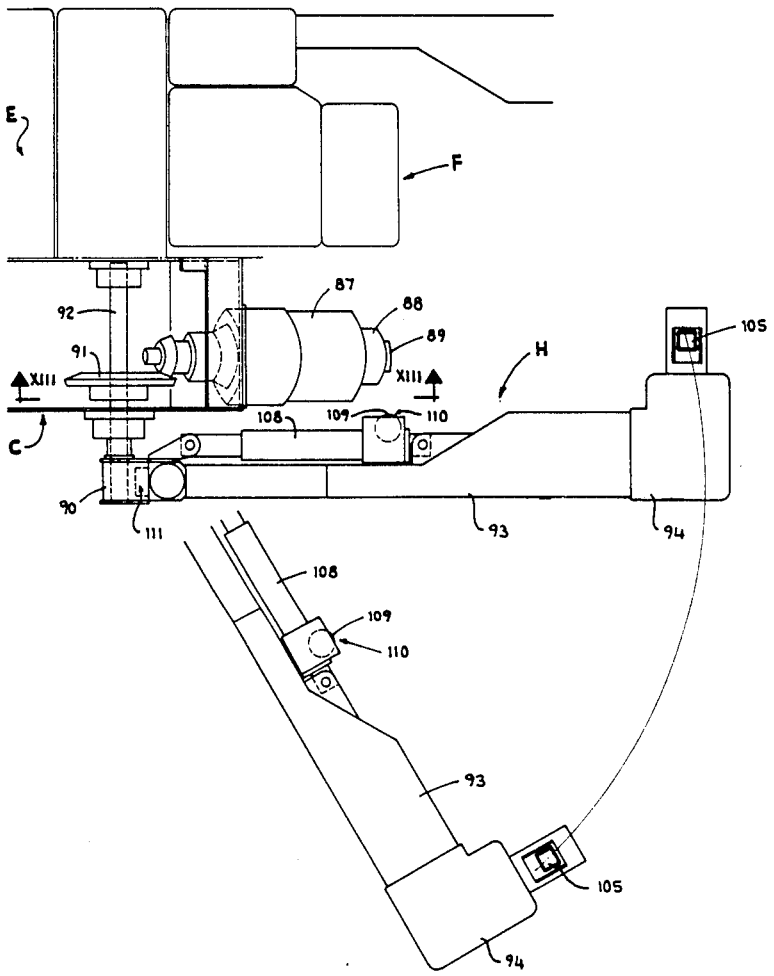
FIG. 12 is a plane view of the support leverages of the legs shown in FIG. 11.
Figure 14:
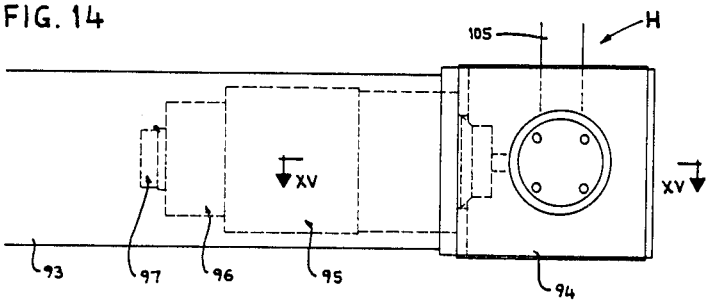
FIG. 14 is a lateral view of the, in itself original, terminal motion assembly of the support leverages of the legs.
Figure 15:
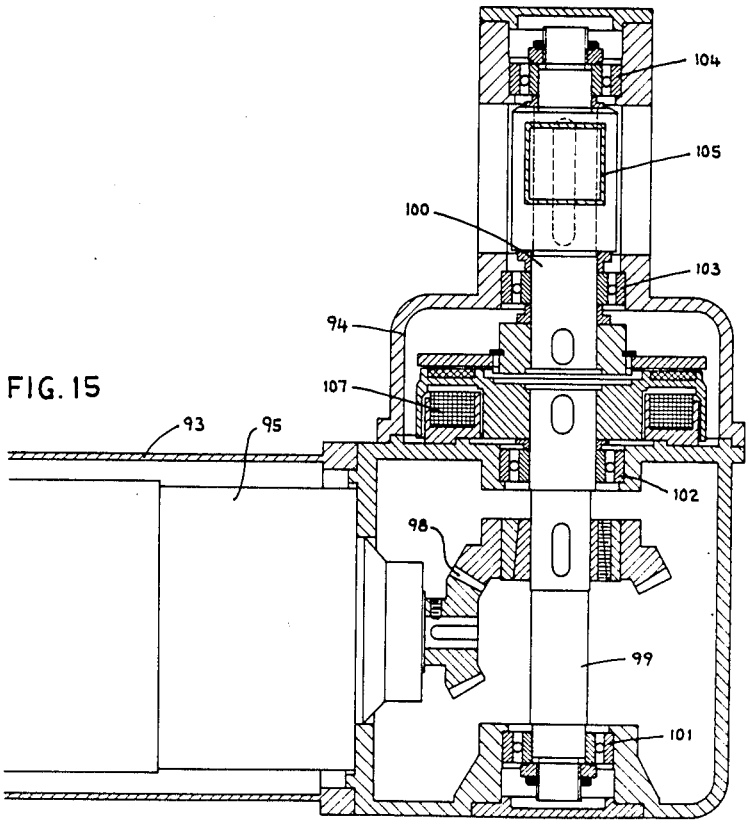
FIG. 15 is the longitudinal section according to the line XV—XV of FIG. 14.

From the FIGS. 3 and 4 can be noticed that said decubitus plane C includes a frame 34 on which is rigidly fixed a cushion 35, while, anchored, through articulated points, the above mentioned headrest D, a back area E, the thighrest F, the arm support leverages G and the leg support leverages H are provided.

The headrest D includes in its turn: a frame 36 on which is fixed the cushion 37 which in the central zone shows an empty zone for anatomical needs when the patient body is in a prone position; the linear actuator 38, which can be operated by the motor 39, allows the positioning of the headrest as required.

The back zone E includes a frame 40 too, on which are accomodated bearings 41 fixed to chains with slotted links 42 which, through leverages 43, 44 and 45 are operated by principal levers 46 keyed to a shaft 47, the rotation of which is transmitted, through the gear pair 48, by a geared motor 49. The movable cushions system 41 allows a movement of flexural-extension of the whole vertebral column; the gradual shifting performed by said cushions 41 during the movement, compensates the negative effect produced by the different position between the rotation center of the cushions 41 and the coxal-femoral articulation of the patient; the speed and the angle shot of the movement can be controlled respectively by the speedometer dynamo 50 and detector of angular position or encader 51.

The thigh-tests F (FIGS. 5, 6) include in its turn frames 52 on which cushions 53 and rollers 54 are fixed that accomodate pilot bars 55 fixed to little movable frames 56 on which cushions 57 are fixed. Through the operation of linear actuators 58 which can be operated by motors 59 and controlled by detectors of angular position 60, the thigh-rests F can rotate upwards as needed so as to support the thighs at the beginning of the movements of flexural-extension of the hips and of the knees, with the patient in supine position. Besides, the thigh-rests F can rotate downwards at an extension sufficient to free the zone during the flexural-extension movements with the patient in prone position and during the abduction movements of the hips. Further linear actuators 61, operated by motors 62, have the function to regulate the cushion position 57 according to the sizes of the patient.

The arm support leverages G (FIGS. 7, 8, 9, 10) include guides 63, assembled on supports 64 and on which run sliders 65 which accomodate wheelwork boxes 66 assembled on bearings 67 and 68 and driven by geared motors 69, which can be controlled as speed and angle shot respectively by speedometer dynamos 70 and angular position detectors 71 and as torque by torque detectors (incorporated in 69), which allow the movement of lateral inclination of the leverages.

On the wheelwork boxes 66 are assembled, on bearings 72 and 73, pins 74 which, through the gear pairs 75 and the geared motors 76, controllable by the speedometer dynamos 77 and angular position detectors 78, transmit the radial movement to levers 79 on which are hinged levers 80, that bear at the ends articulated handles 81.

Through handwheels 82, screws 83 and nutscrews 84, it is possible to regulate the handgrip position of said handles 81. The radial movement and the lateral inclination of the leverages G, allow the before placing and abduction movements of the shoulders and those of flexural-extension of the elbows. At last further linear actuators 85 are provided, controlled by motors 86, which act to center the rotation axis of the leverages in correspondence of the scapula-humeral articulations of the patient.

The leg support leverages H (FIGS. 11, 12, 13, 14, 15) include: geared motors 87, controlled by speedometer dynamos 88 and angular position detectors 89, which transmit the rotation to brackets 90 through gear pairs 91 and shafts 92. On the brackets 90 are pivoted, at right angle with the rotation axis of the shafts 92, mechanical arms 93 at the end of which are accomodated wheelworks boxes 94 in which, through geared motors 95 controlled by speedometer dynamos 96 and angular position detectors 97 and gear pairs 98, rotate propeller shafts 99 and 100, assembled on bearings 101, 102, 103 and 104.

To said shafts 99, 100 are keyed lever 105 to the end of which are pivoted brackets 106 that support the patient feet.

The connection of the shafts 99 and 100 is carried out by electromagnetic clutchs 107 which, when disengaged, allow the free rotation of the levers 105, enabling the regulation according to the patient size and the movements with outstretched legs. The linear actuators 108, pivoted on the brackets 90 and on the mechanical arms 93, operated by the motors 109 controlled by speedometer dynamos 110 and by angular position detectos 111, transmit the horizontal rotation to the mechanical arms 93. The vertical and horizontal rotation of the leverage systems H, allows the movements of flexural-extension and abduction of the hips and of flexural-extension of the knees. During the flexural-extension and abduction phase of the hips in supine position, the patient legs are oustretched and constrained to the above mentioned levers 105; therefore, in order to follow the natural rotation arc of the coexfemoral articulations, the levers 105 are released from the transmissions by the disingagement of the clutches 107.

During the phase of flexural-extension of the hips and knees, both in supine and prone position, the levers 105, made integral with the transmissions by the clutches 107, and the mechanical arms 93, rotate, automatically synchronized, in an optimal manner in order to allow the natural movements of the patient limbs.

Figure 16:
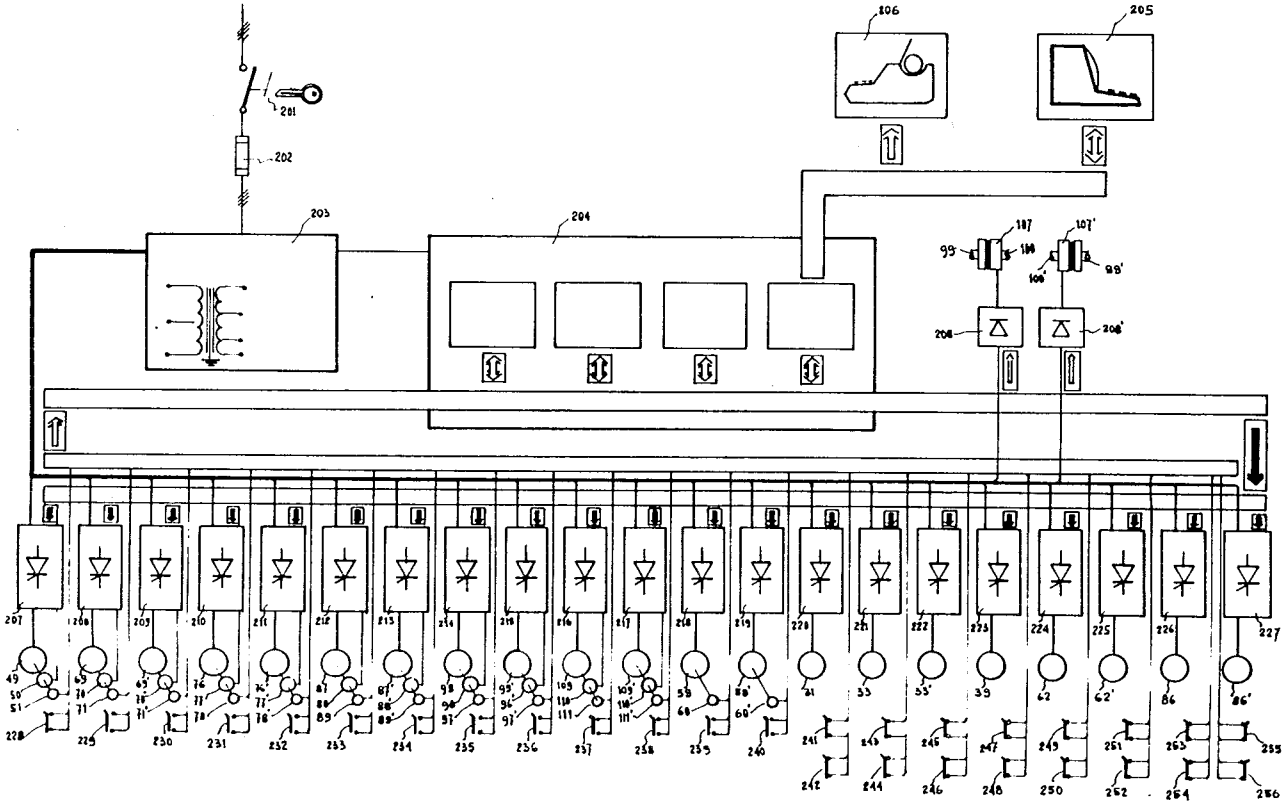
FIG. 16 is the comprehensive block view of the electro-electronic monitoring circuit of the bed according to the invention.

The diagram shown in FIG. 16 points out all the elements needed for the motion of the bed for motor re-education, and so it clears up its operation.

A three-phase line (380 V. 50 Hz–440 V. 60 Hz) arrives upstreams of the switch 201 with key block system; when this is on, through a tern of fuse 202, goes to aliment the transformer group 203.

The last has the function to aliment, at its turn, the microprocessor 204, and the feeders of the operations 207 to 227 included and two rectifier groups 208 and 208'.

Each operation has the function to feed a DC motor and controls its speed through the speedometer dynamo or through the current ring where, in the system, the speedometer dynamo is lacking.

The operations inserted in the system for the motion of the motor re-education bed are in all twenty-one, of which: eleven of work operated wholly by microprocessor 204; two of work operated by the microprocessor 204 through a fixed speed reference and eight of positioning in relation to which the microprocessor 204 limits itself to operate stop and security signals.

By examining at close quarters the diagram of FIG. 16, we can notice—first of all—the eleven work operations with the respective motors, speedometer dynamos, angular position detectors, limit switches, and underline the specific function for each single movement:

(1) flexural-extension of the backbone:

Operation 207, motor 49, speedometer dynamo 50, angular bidirectional detectors with zero 51, limit switch for reference zero 228.

(2) Before placing movement of right arm:

Operation 210, motor 76, speedometer dynamo 77, angular bidirectional detectors with zero 78, limit switch for reference zero 231, (3) Before placing movement of link arm:

Operation 211, motor 76', speedometer dynamo 77', angular bidirectional detector with zero 78', limit switch for reference zero 232.

(4) Abduction-movement of the right arm:

Operation 208, motor 69, speedometer dynamo 70, angular bidirectional detectors with zero 71, limit swtich for reference zero 229.

(5) Abduction movement of the link arm:

Operation 209, motor 69', speedometer dynamo 70', angular bidirectional detectors with zero 71', limit switch for reference zero 230.

(6) Flexural-extension movement of the right leg:

Operation 212, motor 87, speedometer dynamo 88, angular bidirectional detectors with zero 89, limit switch for reference zero 233.

(7) Flexural-extension movement of the left leg:

Operation 213, motor 87', speedometer dynamo 88', angular bidirectional detectors with zero 89', limit switch for reference zero 234.

(8) Abduction movement of the right leg:

Operation 216, motor 109, speedometer dynamo 110, angular bidirectional detectors with zero 111, limit switch for reference zero 237.

(9) Abduction movement of the left leg:

Operation 217, motor 109', speedometer dynamo 110', angular bidirectional detectors with zero 111', limit switch for reference zero 238.

(10) Flexural-extension movement of the right knee:

Operation 214, motor 95, speedometer dynamo 96, angular bidirectional detectors with zero 97, limit switch for reference zero 235.

(11) Flexural-extension movement of the left knee:

Operation 215, motor 95', speedometer dynamo 96', angular bidirectional detecors with zero 97', limit switch for reference zero 236.

We shall see now the two possible work operations at fixed speed with respective motors, angular detectors, limit switches and specific function for each single movement:

(12) Movement for right thigh rest:

Operation 218, motor 59, angular bidirectional detector with zero 60, limit switch for reference zero 239.

(13) Movement for link thigh rest:

Operation 219, motor 59', angular bidirectional detector with zero 60', limit switch for reference zero 240. The eight possible positionings with the respective motors, end limit switches are at last as follows:

(14) Extension movement for right thigh rest: Operation 224, motor 62, end limit switch 249–250.

(15) Extension movement for link thigh rest:

Operation 225, motor 62', end limit switch 251–252.

(16) Slider movement for centering the rotation axis of the right arm:

Operation 116, motor 86, end limit switch 253–254.

(17) Slider movement for centering the rotation axis of the left arm:

Operation 227, motor 86', end limit switch 255–256.

(18) Lifting movement of the decubitus plane:

Operation 220, motor 31, end limit switch 241–242.

(19) Rotation movement of the decubitus plane, motor 1:

Operation 221, motor 33, end limit switch 243–244.

(20) Rotation movement of the decubitus plane, motor 2:

Operation 222, motor 33', end limit switch 245–246.

(21) Head-rest cushion movement:

Operation 223, motor 39, end limit switch 247–248.

The two friction clutch groups, controlled by the microprocessor 204, with or without insertion, according to an operation logica, with the specific function for every single movement are at last the following:

(1) Mechanical connection of shafts 99 and 100 right leg:

Clutch alimentation rectifier 208, clutch 107.

(2) Mechanical connection of shafts 99' and 100' left leg:

Clutch alimentation rectifier 208', clutch 107'.

The compact central unit 204 is a microprocessor composed by several cards with specific duties. Owing to the system complexity we list some of the cards that are possibly contained in the same:

UPC, central process unit, parameter storages, variable storages, code storages, diagnostics, requests management for parameters change, logic input and output cards for interlocking of manual controls of motors not controlled by angular detectors or encoders, cards of input encoders and output analogue signal for operations card with floating battery for the storage of the stated data and of the number of the effected cycles which acts in order not to loose the data in the case of tension lack on the supply mains.

The microprocessor 204 has various functions. Apart from operating and controlling the machine movements, it has to control the couple values which the patient opposes to the movement and to stop the machine if these are exceeded in comparaison with the programmed ones; it has to inform the operator if the stated programs are compatible with those inserted in the storage as possible movements, to control and operate the protections of the motor re-education bed, to inform the operator, through the video 205, of the reason why the stop of movements in wwork course has occurred, to inform the operator, through the video 205, on possible machine anomalies and on possible errors that the operator may commit during the movement programming or during the movements themselves.

Another function of the microprocessor 204 is that to print through the printer 206 the program carried out by the machine for that determinate patient and logically all the possible variations occurred during the work cycle.

The microprocessor 204, through a code that the operator sends through the alphanumeric keyboard 205, allows the operator to operate an axis at a time, so as to effect gauging operations, i.e. to obtain the values needed for defining a personified program for the patient that is executing for the first time the exercise with the motor re-education bed, according to the invention.

As said in the preamble, we have so described a preferred form of execution of the bed for motor re-education bed according to the invention.

As a person skilled in the art can understand, one can neverless bring to the same numerous variations without goind out the scope of the invention, that includes all these variations and is exactly defined by the following claims.

We claim:

1. A bed particularly constructed for the motor re-education of a patient, said bed comprising a base, an elongated support frame, first support lever means extending between said base and said support frame for raising and lowering said support frame relative to said base and selectively tilting said support frame about an axis transversely of the length of said support frame, a head rest, means mounting said head rest for pivotal movement about a transverse axis on said support frame, second support lever means extending between said support frame and said head rest for selectively tilting said head rest relative to said support frame, back rest cushion means on said support frame defining a back zone, leg supports pivotally carried by said support frame for vertical movement relative to said support frame, arm supports carried by said support frame, and a control unit for effecting movement and positioning of each of said first support lever means, said second support lever means and said leg supports, each of said control units including a motor unit for effecting movement, a speedometer dynamo coupled to each motor unit for controlling the speed of operation of each of said motor units, an angle detector for detecting the angular position effected by the respective motor unit, together with a torque detector for each of said motor units and a control device for receiving and sending signals to said motor units for selecting the speeds of operation of said motor units and angular positions to which said support frame, said head rest and said leg supports are moved to allow a patient to execute a complete range of selected single, simultaneous and variously alternative exercises relating to flexural-extension movement of a patient's backbone, said control device including a microprocessor for programming the separate actuation of each of said motors in accordance with a selected exercise.

2. Bed for motor re-education according to claim 1, wherein said first support lever means include support levers and thrust levers, said thrust levers being pivoted on said support frame, and by a pair of actuators connecting said support frame to said base; a pair of screws and respective nuts connected between said base and said thrust levers, the rotation of said screws being transmissible through couples of gears keyed to a shaft by a respective one of said motor units in the form of a geared motor; another of said motor units being connected to said actuators to pivot said actuators and thereby allow a decubitus plane of said support frame to pass from the horizontal to the vertical position in one direction and a negatively sloping position of about 12° in the opposite direction.

3. Bed for motor re-education according to claim 1, together with mechanical units for driving movements of the backbone of the patient, said mechanical units including levers connected together and to further levers pivoted to a transmission shaft; and said back rest cushion means includig movable cushions fixed on two slotted chains, said cushions, being connected to said levers to be progressively separable through the motion of the levers so as to enable the patient not to feel the effect of the change of length of the bed.

4. Bed for motor re-education according to claim 1, together with mechanical units for driving the movements of the patient arms, said mechanical units including articulated rods, screw devices connected to said articulated rods, for revolving said articulated rods both in a horizontal and a vertical plane through two boxes each containing suitable wheelworks, said wheelworks being arranged so as to allow each of said boxes to rotate on bearings driving by a geared motor which is one of said motor units for effecting the vertical rotation of said articulated rods, a pin extending transversely to said boxes, said pin being mounted for rotation on bearings and driven through a gear pair driven by another geared motor for effecting the horizontal rotation of said articulated rods, wherein both vertical and horizontal rotations of said articulated rods can take place selectively singularly and together.

5. Bed for motor re-education according to claim 1, together with said mechanical units for effecting the movement of the patient legs, each of said mechanical units including first and second articulted levers both adjustable as position, boxes located at an end of said first articulated levers for adjusting the positions of said second articulated levers, said boxes containing special wheelworks including two shafts assembled on bearings and driven through gears by a geared motor which is one of said motor units; a clutch interposed between said shafts for releasing said second articulated levers, brackets support said first articulated levers, said brackets being keyed on a transmission shaft driven, through gears by a geared motor which is one of said motor units for producing vertical rotation of said articulated levers wherein said rotation of said articulated levers can selectively take place singularly, together and simultaneously together with a further horizontal rotation of said articualted levers through actuators pivoted on the first articulated levers and on said brackets.

6. Bed for motor re-education according to claim 1, wherein the number of said motor units is preferably twenty-one, said motor units being DC motors of a low voltage type, eleven of said motor units operable completely by said microprocessor, two others of said motor units are operable by said microprocessor through a fixed speed reference, and the remaining eight of said motor units being coupled to said microprocessor for only stop and safety signals.

7. Bed for motor re-education according to claim 1, wherein said microprocessor has an alphanumeric keyboard for allowing an operator to impose only permitted movements, said microprocessor also has a monitor and a printer for allowing an operation to visualize the stated date, to learn the continuous revision of a program, the movement cycles into execution, the diagnostic of possible anomalies and to print the programs for filing and to evaluate therapeutical results thereby allowing the patient to keep to restore a certain sensibility and consciousness with the external world; to have inhibited articular rigidities, to achieve a better circulation of the blood, not to fear the arising of oedemas, to keep a good asteoarticular trophism and muscular elasticity and to help the memory and the harmonic succession fo the gestures.

* * * * *